US005163340A

United States Patent [19]

Bender

[11] Patent Number: 5,163,340

[45] Date of Patent: Nov. 17, 1992

[54] HANDICAPPED PERSON CONTROL APPARATUS

[76] Inventor: Armon J. Bender, P.O. Box 100, Pomona, Calif. 91769

[21] Appl. No.: 760,381

[22] Filed: Sep. 16, 1991

[51] Int. Cl.[5] ..... G05G 1/10

[52] U.S. Cl. ..... 74/553; 74/501.6; 74/523; 414/921

[58] Field of Search ..... 74/501.5 R, 502.1, 501.6, 74/523, 553, 557; 414/921; 280/304.1, 304.5; 248/689

[56] References Cited

U.S. PATENT DOCUMENTS 4,805,479 2/1989 Brightwell ..... 74/501.5 R X
5,010,780 4/1991 Hatfield ..... 74/523 X
5,040,813 8/1991 Cumbie ..... 280/304.1

*Primary Examiner*—Leslie A. Braun
*Assistant Examiner*—Andrea Pitts
*Attorney, Agent, or Firm*—Leon Gilden

[57] ABSTRACT

An apparatus arranged for mounting to a wheel chair and the like for utilization by handicapped individuals to include a support frame mounted to an arm of the wheel chair structure or adjacent support rod, with the support frame including a rear plate and forward plate mounting securement members for fastening to the support rod. A clamp housing mounts a remote control device, such as for utilization with electronic equipment such as televisions and the like, with a sheath directed through a forward wall of the clamp housing, with the sheath including a flexible rod directed therethrough, wherein the flexible rod is reciprocated by use of a push-button member to direct the flexible rod against a control button of the associated remote control apparatus.

4 Claims, 4 Drawing Sheets

Fig 1
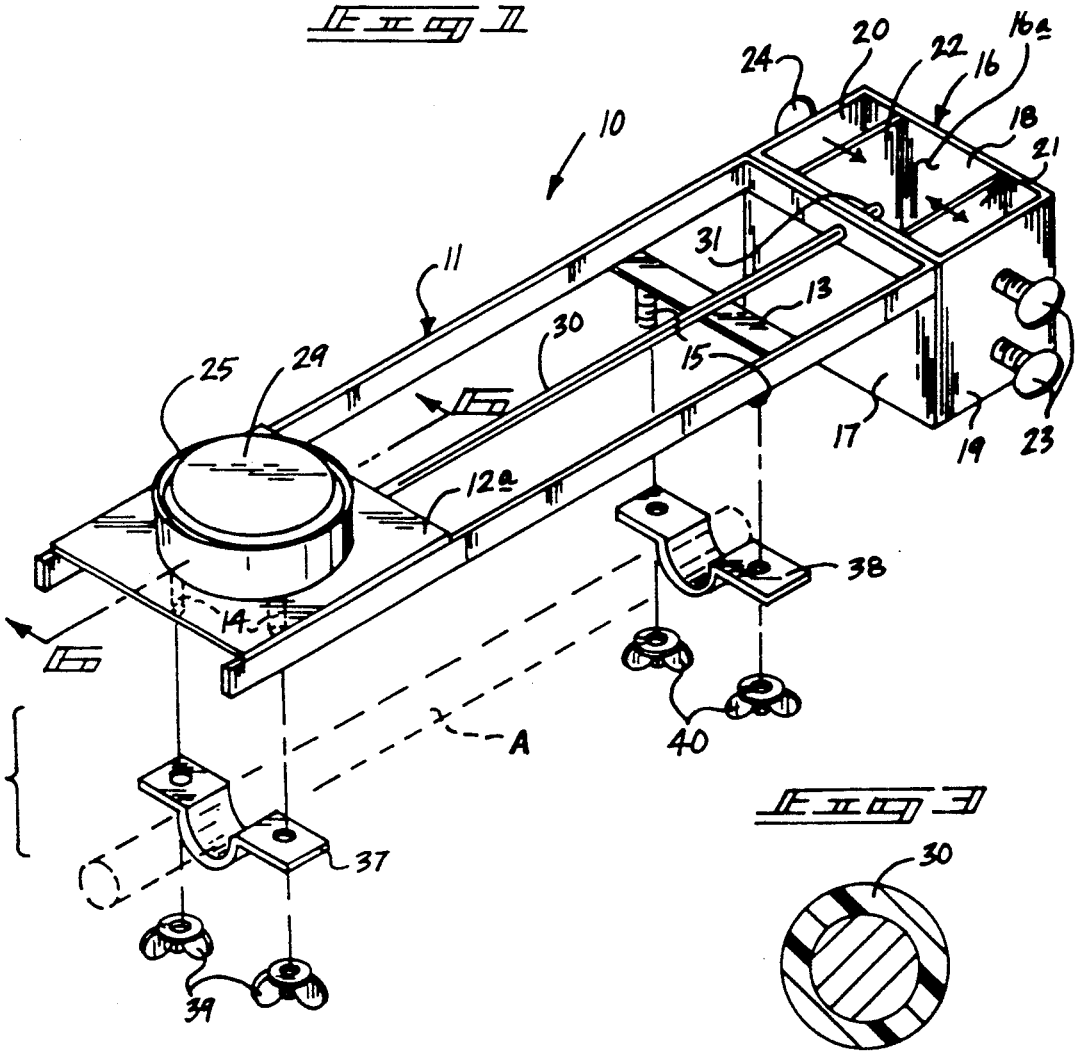
Fig 3
Fig 2
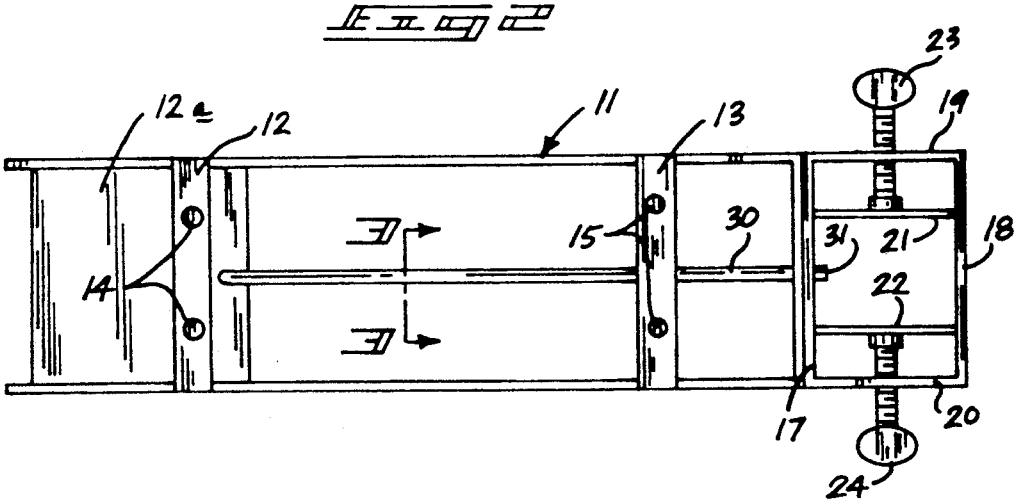

HANDICAPPED PERSON CONTROL APPARATUS

BACKGROUND OF THE INVENTION

1. Field of the Invention

The field of invention relates to control devices, and more particularly pertains to a new and improved handicapped person control apparatus wherein the same is arranged for mounting a remote control device therewithin and permitting its selective actuation.

2. Description of the Prior Art

Handicapped individuals and individuals of diminished physical capacity have at times difficulty in the utilization of contemporary remote control devices whose buttons are of a relative small cross-sectional configuration. The instant invention provides for a support structure to mount the remote control device in an orientation to permit the actuation of at least one button of the remote control device as noted.

Prior art devices for use by handicapped individuals are available in the prior art and exemplified by U.S. Pat. No. 4,821,417 to Levine wherein the device permits utilization of tools and utensils by handicapped individuals permitting mounting of selective utensils within support sleeve structure of the apparatus.

U.S. Pat. No. 4,277,213 to Morewood sets forth a self-feeding device for handicapped individuals providing for a pivotally mounted utensil arranged relative to a support plate, wherein the support plate is arranged for positioning food and the like thereon.

As such, it may be appreciated that there continues to be a need for a new and improved handicapped person control apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of remote control apparatus now present in the prior art, the present invention provides a handicapped person control apparatus wherein the same is arranged for mounting a remote control device for selective actuation by an individual of diminished physical capacity. As such, the general purpose of the present invention, which will be described subsequently in greater detail, is to provide a new and improved handicapped person control apparatus which has all the advantages of the prior art remote control apparatus and none of the disadvantages.

To attain this, the present invention provides an apparatus arranged for mounting to a wheel chair and the like for utilization by handicapped individuals to include a support frame mounted to an arm of the wheel chair structure or adjacent support rod, with the support frame including a rear plate and forward plate mounting securement members for fastening to the support rod. A clamp housing mounts a remote control device, such as for utilization with electronic equipment such as televisions and the like, with a sheath directed through a forward wall of the clamp housing, with the sheath including a flexible rod directed therethrough, wherein the flexible rod is reciprocated by use of a push-botton member to direct the flexible rod against a control button of the associated remote control apparatus.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved handicapped person control apparatus which has all the advantages of the prior art control apparatus and none of the disadvantages.

It is another object of the present invention to provide a new and improved handicapped person control apparatus which may be easily and efficiently manufactured and marketed.

It is a further object of the present invention to provide a new and improved handicapped person control apparatus which is of a durable and reliable construction.

An even further object of the present invention is to provide a new and improved handicapped person control apparatus which is susceptible of a low cost of manufacture with regard to both materials and labor, and which accordingly is then susceptible of low prices of sale to the consuming public, thereby making such handicapped person control apparatus economically available to the buying public.

Still yet another object of the present invention is to provide a new and improved handicapped person control apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of the instant invention.

FIG. 2 is an orthographic bottom view of the instant invention.

FIG. 3 is an orthographic view, taken along the lines 3—3 of FIG. 2 in the direction indicated by the arrows.

DESCRIPTION OF THE PREFERRED EMBODIMENT

Figure 4:
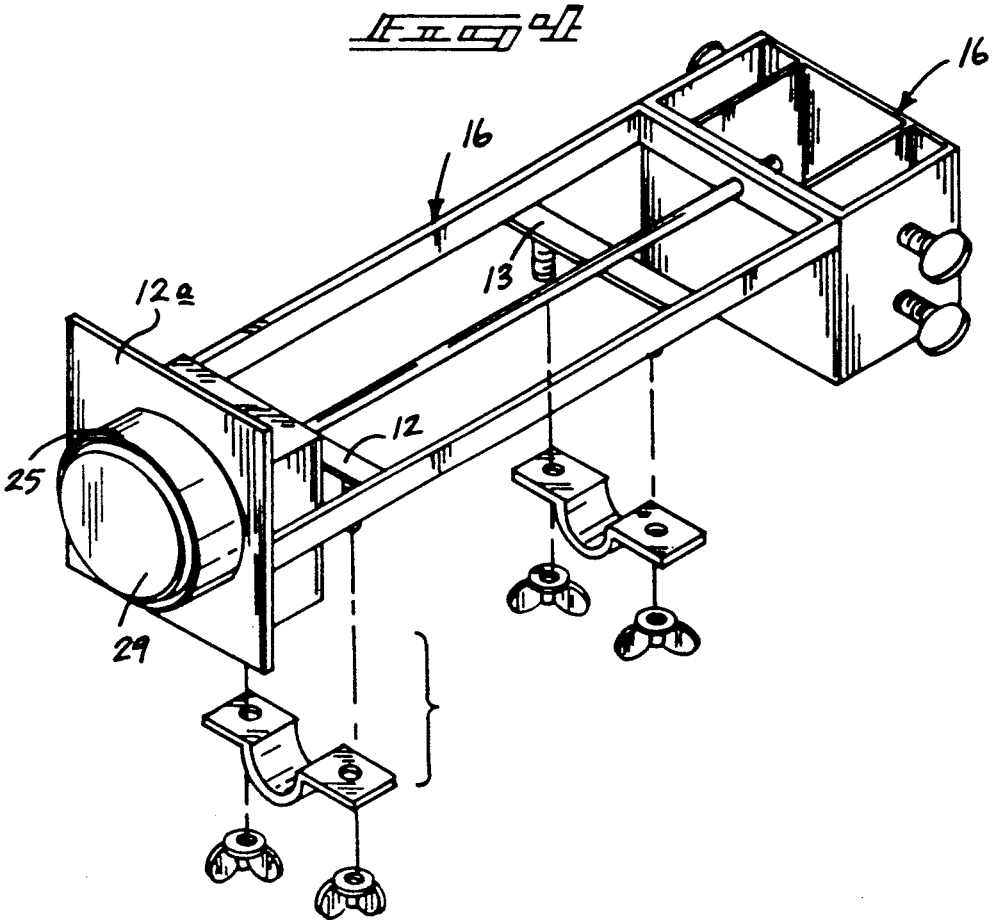
FIG. 4 is an isometric illustration of a modification of the invention.
Figure 5:
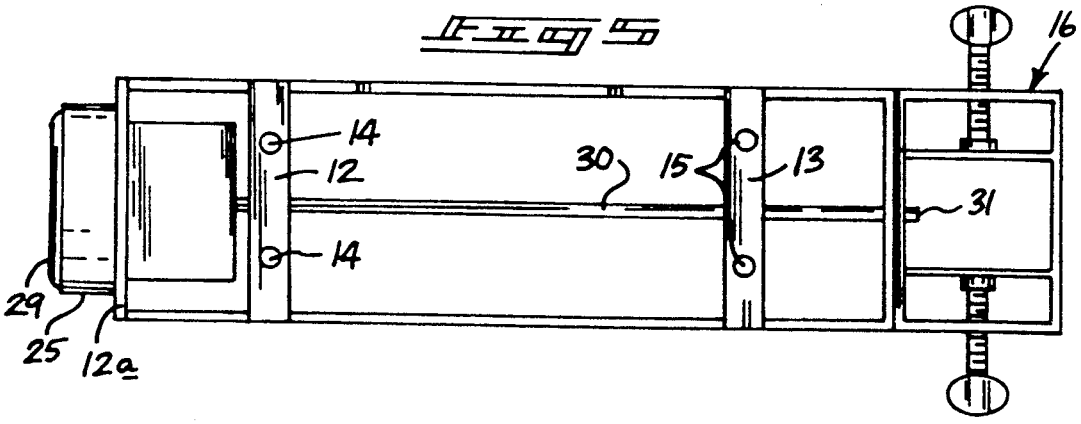
FIG. 5 is an orthographic bottom view of the instant invention, as set forth in FIG. 4.
Figure 6:
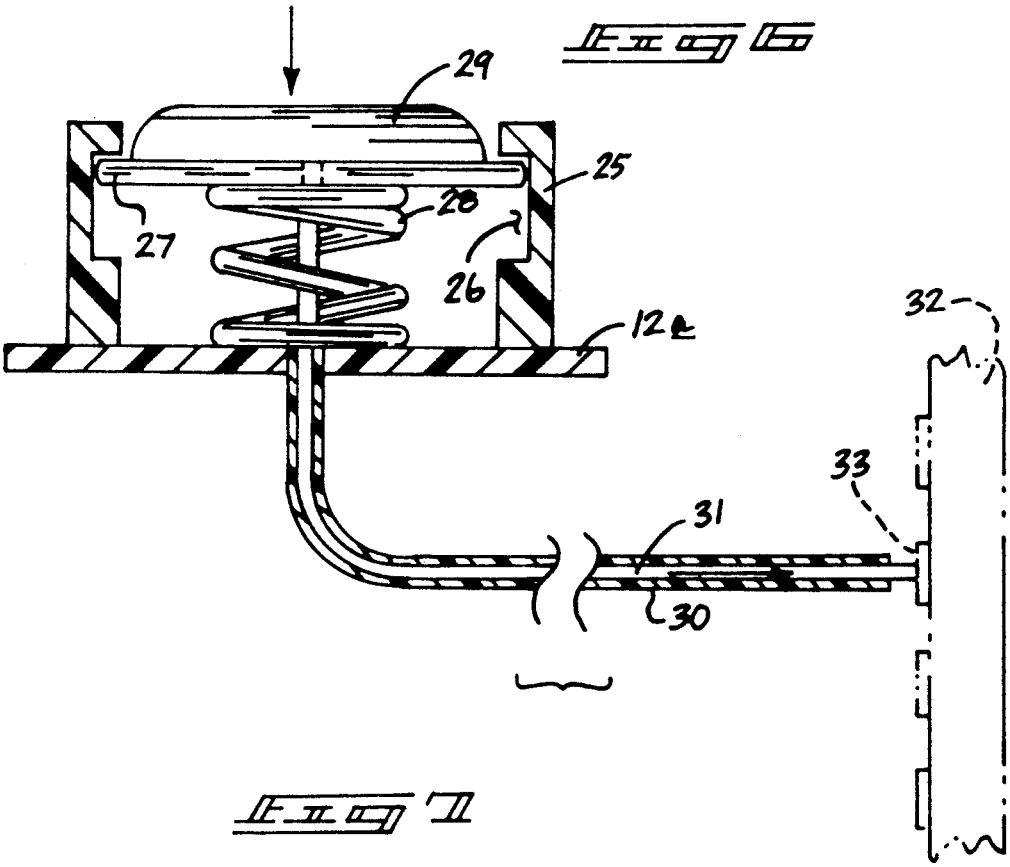
FIG. 6 is an orthographic view, taken along the lines 6—6 of FIG. 1 in the direction indicated by the arrows.
Figure 7:
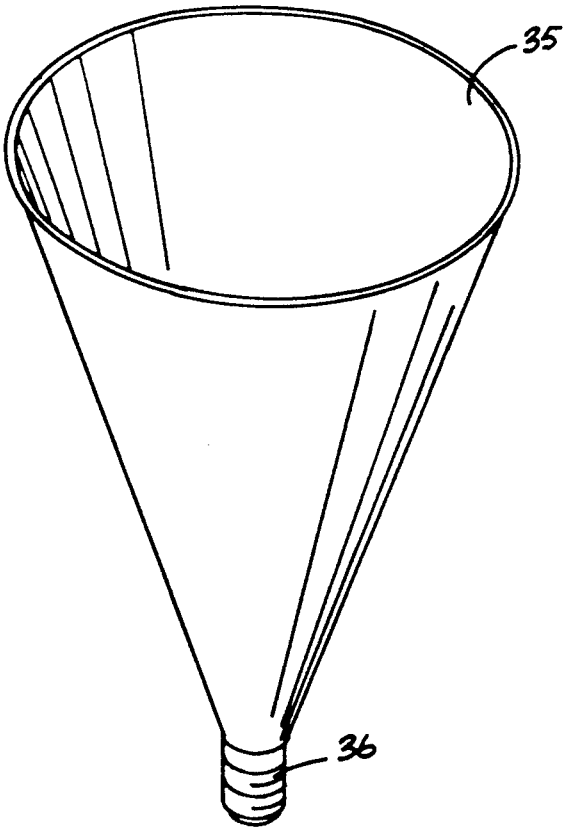
FIG. 7 is an isometric illustration of an enlarged contact member for use by the invention.

With reference now to the drawings, and in particular to FIGS. 1 to 9 thereof, a new and improved handicapped person control apparatus embodying the principles and concepts of the present invention and generally designated by the reference numeral 10 will be described.

More specifically, the handicapped person control apparatus 10 of the invention essentially comprises an apparatus longitudinally aligned along a straight line support frame 11, including a rear plate 12 spaced from and parallel a forward plate 13. The rear plate 12 is positioned in the bottom, as illustrated in FIG. 1, underlying a button support plate 12*a*.

A plurality of respective rear and forward externally threaded rods 14 and 15 are orthogonally and fixedly mounted to extend downwardly from the respective rear and forward plates 12 and 13 for cooperation with respective forward and rear securement members 37 and 38 arranged for clamping about a wheel chair arm "A", wherein respective forward and rear fasteners 39 and 40 are directed onto externally threaded rods 14 and 15 respectively subsequent to position of the securement members about the associated arm "A". A clamp housing 16 is secured to a forward distal end of the support frame 11, including a tubular a cavity 16*a* that is of a parallelepiped configuration and orthogonally oriented relative to the support frame 11. The housing 16 includes a front wall 17 spaced from and parallel to a rear wall 18. The front wall 17 is fixedly mounted to the forward distal end of the support frame 11, wherein respective right and left walls 19 and 20 are mounted to opposed sides of the front and rear walls to define the parallelepiped configuration as described. A respective right and left plate 21 and 22 are slidably contained within the housing and orthogonally oriented relative to the front and rear walls and parallel to the respective right and left walls. Respective right and left threaded thumb screw rods 23 and 24 are threadedly received through the respective right and left walls 19 and 20 and are rotatably mounted at their forward distal ends within the respective right and left walls 19 and 20, in a manner as illustrated in the FIGS. 1 and 2 for example.

The button support plate 12*a* includes a cylindrical housing 25 fixedly mounted thereon, wherein the cylindrical housing 25 includes a continuous recess 26 formed within an interior surface of the cylindrical housing 25 adjacent its upper terminal end. A push button flange 27 is captured within the recess 26 and includes a cushioned button member 29 mounted on an upper surface thereof. A spring 28 is captured between a bottom surface of a push button flange 27 and the button support plate 12*a*. A flexible sheath 30 is fixedly mounted to the button support plate 12*a* and is directed along the frame 11 and fixedly mounted to the front wall 17. A flexible rod 31 is reciprocatably mounted within the sheath 30 whose rear terminal end is secured coaxially to the push flange 27 to a bottom surface thereof, wherein the rod 31 projects interiorly of the tubular clamp housing cavity 16*a* for alignment of the forward distal end of the flexible rod 31, with a remote control unit button 33 of an associated remote control unit housing 32 that is clamped between the right and left clamp plates 21 and 22.

Figure 8B:
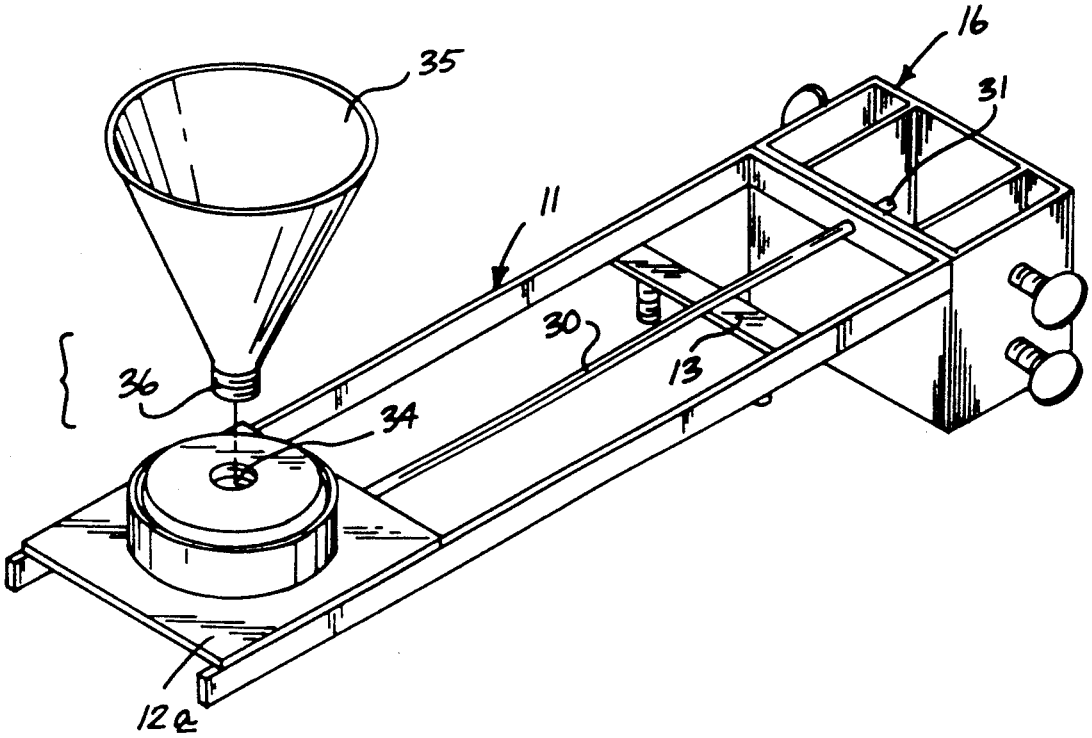
FIG. 8 is an isometric illustration of the contact member in use by the instant invention.
Figure 9:
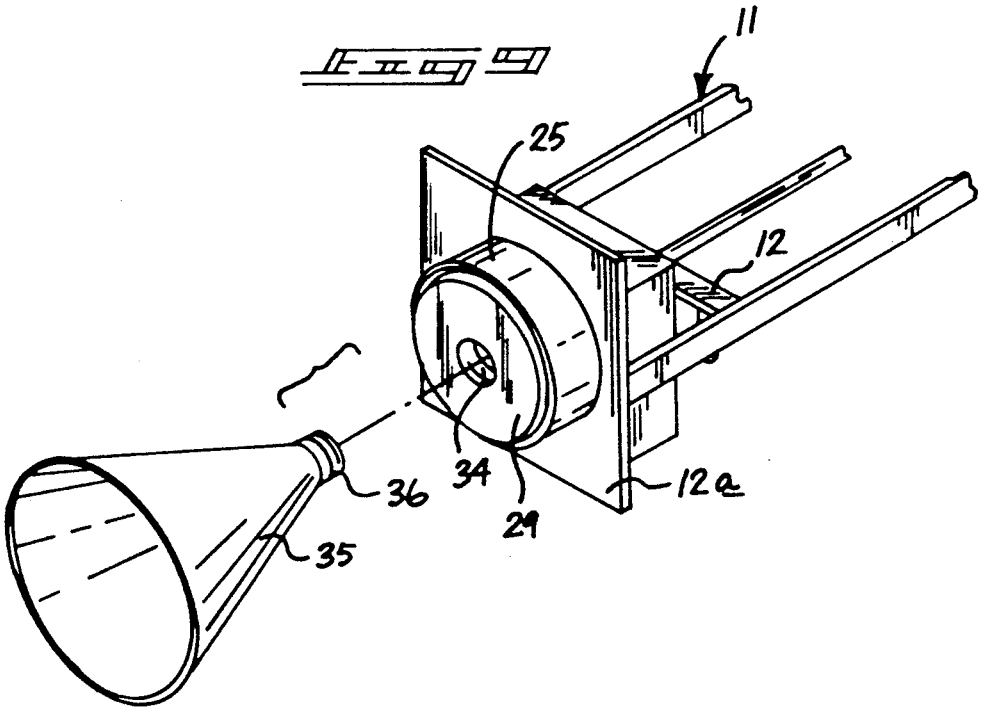
FIG. 9 is an isometric illustration of the contact member in use by the modification of the invention.

To provide for enlarged contact member for use by an individual of limited capacity, a flexible outwardly flared contact member 35 is provided and formed with a lower externally threaded end 36 that is receivable within a button member central internally threaded bore 34 of a type as illustrated in the FIGS. 8 and 9. In this manner, the enlarged outwardly flared contact member 35 is merely impacted at relatively any angle by an individual for depressing of the button 29. The organizations of the FIGS. 4 and 9 for example illustrate the button support plate 12*a* orthogonally oriented relative to the frame 11 where it is understood that various angular orientations of the button support plate 12*a* as required relative to a wheel chair or the like is available to one of ordinary skill in the art.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A control apparatus for use by handicapped individuals for manipulation of a remote control member, including at least one remote control button, wherein the apparatus comprises, a longitudinally aligned support frame, the support frame including a rear plate spaced from and parallel a forward plate, the rear plate including at least one rear securement rod, and the forward plate including at least one forward securement rod, and a forward securement member securable to the securement rod and a rear securement member securable to the rear securement rod, wherein a rear fastener securable to the rear securement rod to secure the rear securement member thereto, and a forward securement fastener securable to the forward securement rod to secure the forward securement member thereto, and clamp housing mounted to a forward distal end of the support frame, wherein the clamp housing includes a parallelepiped cavity, wherein the parallelepiped cavity is orthogonally oriented relative to the support frame, and a rear distal end of the support frame mounts a button support plate, and a flexible sheath, including a sheath rear terminal end, wherein the sheath rear terminal end is fixedly mounted and directed through the button support plate, and a sheath forward terminal end is fixedly secured to the clamp housing, and a flexible rod reciprocatably mounted within the sheath, the flexible rod extending into the parallelepiped cavity at a forward end of the flexible rod, and a rear end of the flexible rod directed through the button support plate, and button means mounted on the button support plate, the button support means receiving the flexible rod and arranged for effecting selective reciprocation of the flexible rod within the flexible sheath, wherein the remote control member is arranged for securement within the parallelepiped cavity, with the forward end of the flexible rod arranged adjacent the remote control button.

2. An apparatus as set forth in claim 1 wherein the button means includes a cylindrical housing mounted to a top surface of the button support plate, the cylindrical housing including a continuous recess formed within an interior surface of the cylindrical housing, and a push button flange captured within the continuous recess, the push button flange diametrically oriented within the cylindrical housing, and the push button flange including a button member mounted to a top surface of the push button flange, and a bottom surface of the push button flange including the rear terminal end of the flexible rod coaxially and fixedly mounted thereto, and a spring member captured between the bottom surface of the push button flange and a top surface of the button support plate.

3. An apparatus as set forth in claim 2 wherein the clamp housing includes a front wall fixedly and orthogonally mounted to the forward distal end of the support frame, and a rear wall spaced from and parallel the front wall, and a right wall and left wall arranged in a spaced parallel relationship orthogonally oriented relative to the front wall and rear wall, and a right clamp plate and left clamp plate each orthogonally oriented relative to the front wall and rear wall slidably contained between the front wall and rear wall, wherein the right clamp plate and left clamp plate include at least one respective right thumb screw rod and left thumb screw rod, wherein the right thumb screw rod is rotatably mounted within the right clamp plate, and the left thumb screw is rotatably mounted within the left clamp plate, and the right thumb screw is threadedly directed through the right wall, and the left thumb screw is threadedly through the left wall, whereupon selective rotation of the right and left respective thumb screw rods effects effective reciprocation relative to one another of the right and left clamp plates.

4. An apparatus as set forth in claim 3 including an outwardly flared contact member of generally conical configuration, wherein a lower apex portion of the contact member includes an externally threaded end, and the button member includes an internally threaded bore, wherein the threaded end is threadedly received within the threaded bore to provide for an enlarged contact surface for effecting depressing of the button member within the cylindrical housing.

* * * * *